United States Patent [19]

Berkhof

[11] 4,406,400

[45] Sep. 27, 1983

[54] DIAPHRAGM OPERATED PRESSURE REGULATOR

[75] Inventor: Hendrikus Berkhof, Emmen, Netherlands

[73] Assignee: Honeywell Inc., Minneaplis, Minn.

[21] Appl. No.: 304,749

[22] Filed: Sep. 23, 1981

[30] Foreign Application Priority Data

Sep. 24, 1980 [DE] Fed. Rep. of Germany ..... 3035925

[51] Int. Cl.[3] ..... G05D 27/00

[52] U.S. Cl. ..... 236/80 F; 137/489; 236/92 A

[58] Field of Search ..... 236/92 R, 92 A, 80 R, 236/80 F; 137/489

[56] References Cited

U.S. PATENT DOCUMENTS

| | | | |
|---|---|---|---|
| 2,611,542 | 9/1952 | Crum et al. | 236/92 A X |
| 3,235,180 | 2/1966 | Graham et al. | 236/80 F |
| 3,307,785 | 3/1967 | Currie | 236/92 A X |
| 3,366,140 | 1/1968 | Dunn | 236/92 A X |
| 4,182,488 | 1/1980 | Berkhof | 236/92 A |

*Primary Examiner*—William E. Tapolcai

*Attorney, Agent, or Firm*—George W. Field

[57] ABSTRACT

A diaphragm operated pressure regulator having jointly operable principal and auxiliary springs, the auxiliary spring being readily exchangeable to vary the control characteristic of the regulator without affecting the maximum and minimum pressure adjustments of the regulator.

4 Claims, 3 Drawing Figures

DIAPHRAGM OPERATED PRESSURE REGULATOR

The invention relates to a diaphragm operated pressure regulator which comprises an improvement on the structure shown in U.S. Pat. No. 4,182,488. There, the diaphragm via an auxiliary spring abuts against a first spring which determines the minimum pressure acting upon the diaphragm, whilst a second spring, determining the maximum pressure acting on the diaphragm, abuts on the one side against a stationary counter piece and on the other side acts on a sleeve which is effective as catch abutment for the transmission lever. The sleeve carries a pin which is located opposite a catch surface of the first spring.

It is the object of the invention, with such a modulating diaphragm pressure regulator to achieve the possibility for easy adjustment of the control characteristic. This is achieved by the invention as shown in FIG. 1. It is known as such in pressure regulators to exchange the spring acting on the diaphragm, if the pressure regulator has to be changed to another pressure range. The invention, however, leads to a solution in which the maximum pressure, and therewith the pressure range, is predetermined by said adjusting spring and therewith this maximum pressure remains the same when the auxiliary spring is exchanged. If the auxiliary spring is exchanged for another spring having a different spring strength, only the steepness of the spring characteristic within the modulating range is changed, however, the maximum as well as the minimum output pressure of the pressure regulator remain the same.

Furthermore, it is desired with the invention to have a control value, for instance the output control signal of a temperature sensor, acting on the pressure regulator in such a manner that, within the modulating range, this measured control value determines the working point of the pressure regulator on the inclined part of its characteristic. Thereat the minimum and maximum values, as adjusted before, should remain unchanged, and the exchangeability and adjustability respectively of the adjustment springs should remain available.

The invention subsequently will be described with reference to two embodiments shown in the drawings. Therein, FIG. 1 shows a first embodiment of the pressure regulator in connection with a servo operated gas control apparatus which can be switched on and off by means of a solenoid valve;

Figure 1:
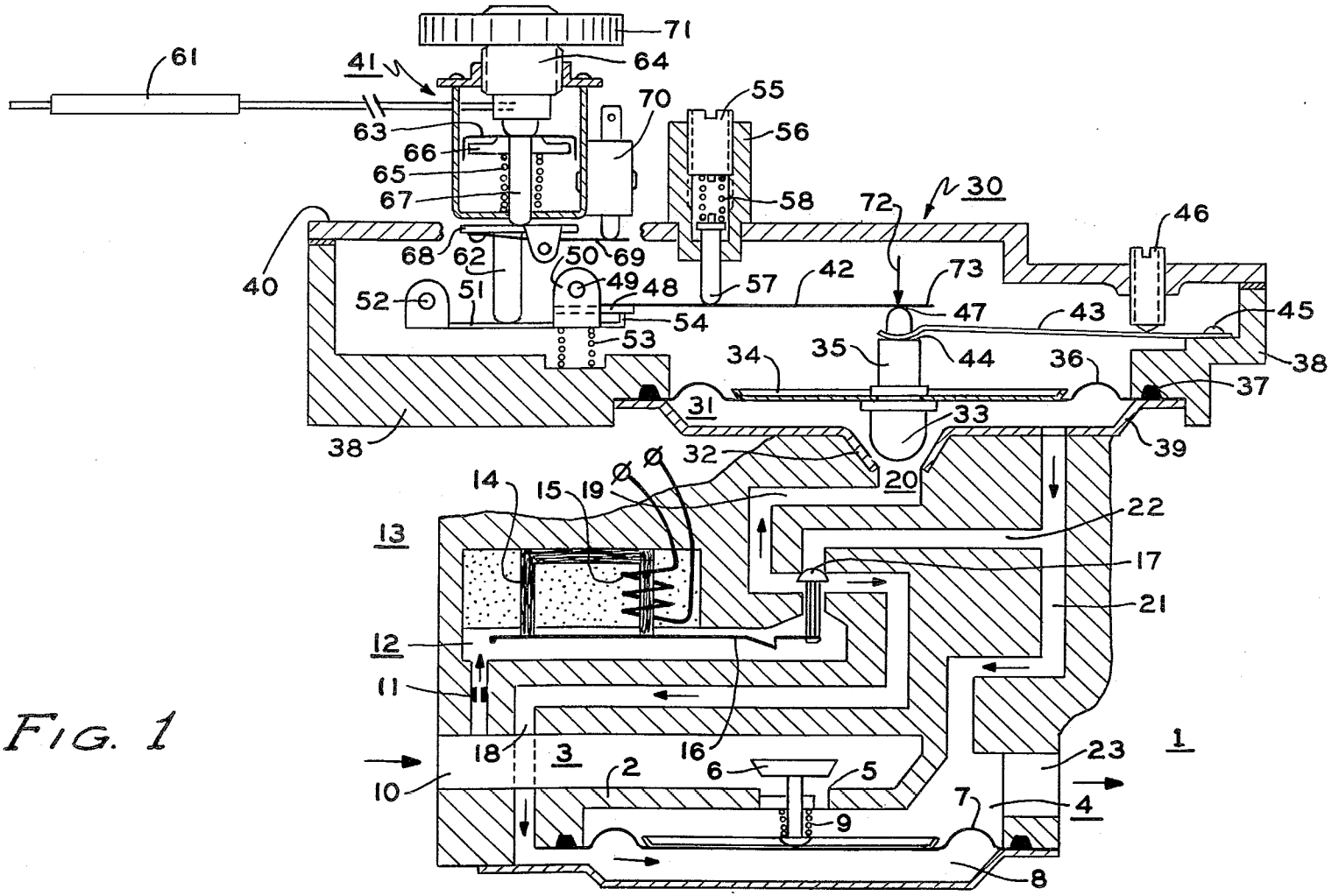

In FIG. 1, the main valve 1 of a gas control apparatus, shown only partially, is controlled by the control pressure generated by a diaphragm operated pressure regulator 30. In the bulkhead 2 between inlet chamber 3 and outlet chamber 4 of the main valve 1, a valve seat 5 is provided which, by means of a closure member 6, can be opened more or less. A diaphragm 7 separates the outlet chamber 4 from a control pressure chamber 8.

The pressure in chamber 8 acts via diaphragm 7 against the force of a closure spring 9 which tries to move closure member 6 in direction of closing main valve 5, 6.

Inlet chamber 3 further is connected to inlet chamber 12 of a solenoid valve 13 via a restriction 11. Solenoid valve 13 in FIG. 1 is shown in the operated condition. It consists of a magnetic core 14, provided with an excitation coil 15 and an armature 16 which carries a closure member 17. In the shown switch-on position of solenoid valve 13, its inlet chamber 12 on the one side via channel 18 is connected to control pressure chamber 8 of main valve 1 and on the other side via channel 19 is connected to the inlet side 20 of pressure regulator 30. Channel 21 connects chamber 31 of pressure regulator 30 to outlet chamber 4 of the main valve.

If, different from the showing in FIG. 1, solenoid valve 13 is in the switch-off position, the connection between chambers 12 and 8 through channel 18 is closed by closure member 17 and, simultaneously, inlet side 20 of pressure regulator 30 on the one hand via channels 22 and 21 is connected to outlet chamber 4 of main valve 1, and on the other hand via channel 18 is in connection with control pressure chamber 8 of the main valve. Solenoid valve 13 is energized when a supply of heat is required, for instance if the temperature in the room or in a water heater falls below a predetermined set point. For generating the required heat, a burner is connected to outlet 23 of main valve 1.

Inlet side 20 of pressure regulator 30 ports into a valve seat 32 which, by means of closure member 33, can be closed more or less. Herewith, the effective cross section of the passage between inlet chamber 20 and pressure regulator chamber 31 is changed which, as mentioned above, via channel 21, is connected to outlet chamber 4 of main valve 1. Closure member 33 by means of diaphragm plate 34 and closure member carrier 35 is connected to diaphragm 36 which closes chamber 31 on the opposite side of valve seat 32. This diaphragm 36 is with a circumferential swelling 37 pressure-tightly clamped between housing 38 of pressure regulator 30 and a plate 39 which simultaneously forms valve seat 32. On the side opposite to chamber 31, a cover 40 is fixed to housing 38, with said cover 40 simultaneously serving as a carrier for a thermomechanical transducer 41.

Closure member carrier 35 and therewith diaphragm 36 are subject to the influence of two adjusting springs 42 and 43. The last mentioned spring 43 abuts against projection 44 of closure member carrier 35 and, at its other end, is held stationarily, for instance is fixed to a part of bottom plate 38 by means of rivet 45. An adjusting screw 46 which can be adjusted in cover 40 acts upon adjusting spring 43 and, by means of adjusting screw 46, the minimum outlet pressure of the pressure regulator may be adjusted. Furthermore, the other adjusting spring 42 engages end 47 of closure member carrier 35 and also is a spring blade. It is supported by intermediate lever 48 which is tiltable around axis 49. This axis is supported in two corner straps 50 of transmission lever 51. This lever is tiltable around stationary axis 52. It is biased in counter-clockwise direction by coil spring 53 which, on the one side, stationarily abuts against bottom plate 38. Free end 54 of transmission lever 51 is bent rectangularily and serves as abutment for limiting rotation of intermediate lever 48 in clockwise direction.

In the same manner as the bias of spring 43 can be determined by means of adjusting screw 46, an adjusting screw 55 for adjusting spring 42 is adjustable within threaded bore 56 of cover 40. An auxiliary spring 58 is provided between adjusting screw 55 and a pin 57, engaging adjusting spring 42. The spring bias of auxiliary spring 58 can be adjusted by means of adjusting screw 55. Auxiliary spring 58 can easily be exchanged. Its stiffness or spring strength determines the steepness of the pressure regulator curve within the modulating range.

The thermomechanical transducer 41, now called a temperature controller, converts the changes of temperature as measured by expansion temperature sensor 61 into a mechanical movement of pin 62. For this purpose, diaphragm capsule 63 on the one side abuts against adjusting member 64 and on the other side can expand against the force of spring 65. A spring plate 66 engages diaphragm capsule 63, and output pin 67 of the transducer is connected to said spring plate 66. It acts upon stationarily supported lever 68 which carries pin 62. Fixed to level 68 is further a spring blade 69 which switches electrical switch 70 when a predetermined temperature limit is exceeded. Adjusting member 64 by means of button 71 can be adjusted and therewith the abutment for diaphragm capsule 63 can be changed in known manner. In this way, the temperature set point is determined.

In the shown embodiment, switching on and off of the pressure regulator 30 is achieved by means of solenoid valve 13 which allows or inhibits the gas supply to the pressure regulator. Another possibility for inhibiting the pressure regulator is that closure member 33 is mechanically drawn away from seat 32 and, in this way, the pressure regulator is blocked. For this purpose, instead of the solenoid valve 13 an electromagnet acting on closure member carrier 35 might be provided and might be fixed to cover 40 in alignment with diaphragm 36 and closure member 33. In the switched-on condition, this electromagnet allows the pressure regulator to operate and in the switched-off position inhibits movement of the closure member carrier 35. Since adjusting screws 55 and 46 as well as transmission lever 51 are located outside alignment of diaphragm 36 and valve 32, 33, a replacement of solenoid valve 13 by such an electromagnet fixed to cover 40 is no problem.

The embodiment of a servocontrolled gas control apparatus with modulating pressure regulator as shown in FIG. 1 operates as follows: it is assumed that a boiler delivers hot water for a radiator provided in a room and that the boiler is heated by a gas burner. This burner is connected to outlet 23. Expansion temperature sensor 61 measures the temperature of the boiler water. Connected in series with energizing coil 15 of solenoid valve 13 is on the one side a contact of a room thermostat which closes as soon as the temperature falls below a predetermined set point. Furthermore, a further contact, namely the normally closed contact of switch 70, is connected with the above mentioned circuit and opens as soon as the boiler water temperature measured by temperature sensor 61 exceeds a maximum limit. If this is the case, the solenoid valve is no longer supplied with current and therewith the gas supply to the burner is interrupted. Gas should flow to the burner only and as long as on the one hand the room temperature is below the adjusted setpoint, that means as long as supply of heat to the room is required, and on the other hand only as long as the present boiler water temperature (sensor 61) is not sufficient for supplying sufficiently hot water to the radiators provided in the room. In this case, a heat supply to the boiler water is necessary. If, however, the boiler water is hot enough for achieving sufficient heat to the room or if no heat supply to the room is requested at all, no gas should be supplied to the burner.

It is assumed that, when switching on the heating system, the room temperature as well as the boiler water temperature are below their respective set-points. As a result, solenoid valve 13 is energized and by means of closure member 17 opens the gas supply on the one side via a channel 19 to pressure regulator 30 and on the other side via channel 18 to control chamber 8 of main valve 1. Pressure regulator 33 determines the pressure within chamber 12 and control chamber 8 as well as in the channels as mentioned above and therewith determines the amount of opening of main valve 5, 6. As assumed, the boiler water temperature measured by sensor 61 is low, and diaphragm capsule 63 is pressed together. Therefore, pin 62 exerts no essential force on transmission lever 51. This lever rather is tilted by spring 53 in counter-clockwise direction as far as possible. Adjusting spring 42 with its central portion abuts against pin 57 and therewith, via auxiliary spring 58, against adjusting screw 55. If spring 53 forces bearing point 49 and therewith the left lever arm of adjusting spring 42 in upward direction, now the right lever arm and therewith the free end 73 of adjusting spring 42 engaging end 47 of closure member carrier 35 is pressed in the direction of arrow 72 with the greatest possible force in the direction to valve seat 32. Closure member 33 closes valve seat 32 and therewith interrupts the connection between channels 19 and 21 so that the control pressure within chamber 12 cannot be relieved via those channels to outlet chamber 4 of the main valve. The full control pressure rather via channel 18 is pressed in control pressure chamber 8 and is pressing diaphragm 7 together with closure member 6 opposite to the force of spring 9 in the fully opened position of main valve 5, 6. Therewith, the highest possible control pressure P exists according to the beginning of the curve of FIG. 2. The amount of this maximum pressure is determined by the position of adjusting screw 55. The further this screw is screwed inwardly, and therewith the auxiliary spring 58 is pressed downwardly, the stronger is the force in the direction of arrow 72, that means the higher is the control pressure which has to be exceeded by the inlet pressure before the pressure regulator becomes operating and relieves part of the inlet pressure to the outlet.

Figure 2:
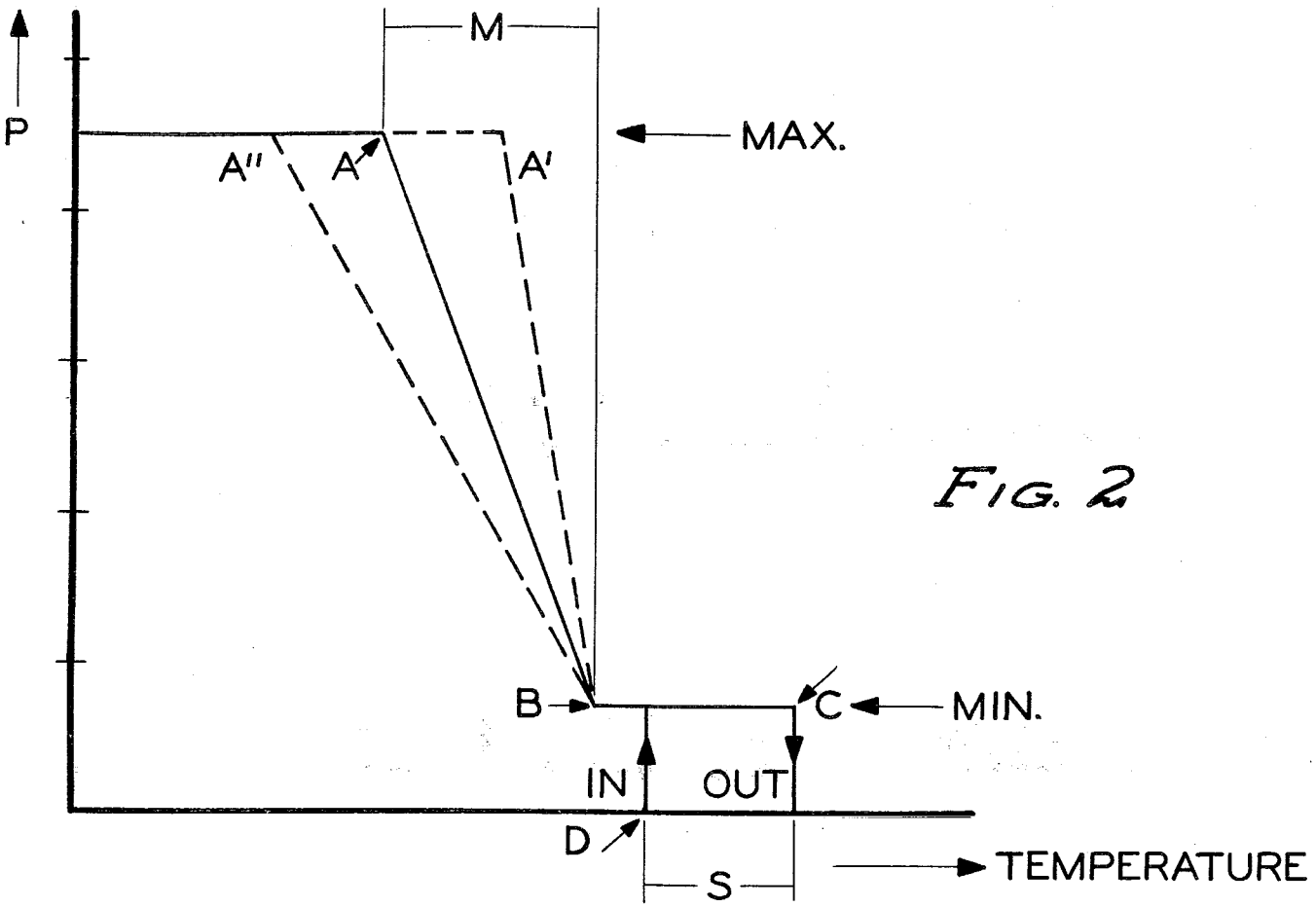
FIG. 2 shows the curve of the outlet pressure P of the pressure regulator dependent on the temperature in a room heated via the gas control apparatus which temperature as a control value acts on the pressure regulator; and further shows the influence of different auxiliary springs on the steepness of the control characteristic.

When the boiler water temperature increases, the force exercised by pin 67 via lever 68 and pin 62 in clockwise direction on transmission lever 51 in point A of the curve of FIG. 2 exceeds the force which, by spring 53, is exercised on transmission lever 51 in counter-clockwise direction. Now, pin 67 starts to tilt lever 68 in counter-clockwise direction. This movement is transmitted to transmission lever 51 by pin 62 so that this transmission lever turns in clockwise direction. Therewith, the pressure is reduced which abutment 54 exercises on adjustment spring 42 in counter-clockwise direction allowing plunger 57 to move downward. The control pressure P decreases since, with moving plunger 57 downward, the force exercised by auxiliary spring 58 and therewith the starting point of the modulating range M is reached. Now the force of adjustment spring 42 acting on end 47 of closure member carrier 35 mainly is determined by the spring force of auxiliary spring 58. The stronger the spring is, the steeper is the curve within the modulating range M. In FIG. 2, the dotted part A'B of the curve corresponds to the use of a stronger auxiliary spring 58 and curve portion A"B corresponds to a softer auxiliary spring 58 than in case A B. Finally, in point B, auxiliary spring 58 is completely unloaded and does no longer exercise a force on adjustment spring 42. This spring therefore is without any further effect. Only adjusting spring 43 acts on closure member carrier 35 and the spring bias of this adjusting spring 43 can be adjusted by means of adjusting screw 46. When the inlet pressure supplied via restriction 11 exceeds this minimum value, closure member 33 opens channels 20, 21 to the outlet so that the control pressure in pressure chamber 8 decreases and main valve 5, 6 is moved in closing direction by means of closure spring 9. In point B of the curve, the minimum outlet pressure of the pressure regulator and therewith also the minimum outlet pressure of the gas control apparatus is reached. Even if the temperature increases further, this minimum outlet pressure remains until reaching point C. If then in the course of further temperature increase as a result of lever 68 being tilted in counter-clockwise direction the blade spring 69 connected to said lever 68 operates switch 40 and therewith interrupts the current circuit for solenoid valve 13, this valve becomes deenergized and its closure member 17 inhibits the gas supply to pressure regulator 30. Simultaneously, control pressure chamber 8 via channels 18 and 21 is relieved from pressure. Main valve, 5, 6 closes.

If now, with the burner switched off, the boiler water temperature measured by sensor 61 falls below the switchoff value switch 20 after passing through the switching differential S closes in point D, solenoid valve 13 pulls in and the burner again is switched on at minimum gas supply. If, in spite of this gas supply, the temperature decreases further, then spring 53 tilts transmission lever 51 in counter-clockwise direction until adjusting spring 42 again engages end 47 of closure member carrier 35 and auxiliary spring 58 again becomes effective. Dependent on the boiler water temperature sensed by temperature sensor 61, the outlet pressure P adjusts to a value within modulating range M between point A and B of the curve.

If the room temperature sensor senses an increase of the room temperature above its set-point, the room thermostat opens and therewith deenergizes solenoid valve 13. Therewith, any gas supply to the burner is switched off in the same manner as this was described earlier in connection with the opening of overtemperature switch 70.

Figure 3:
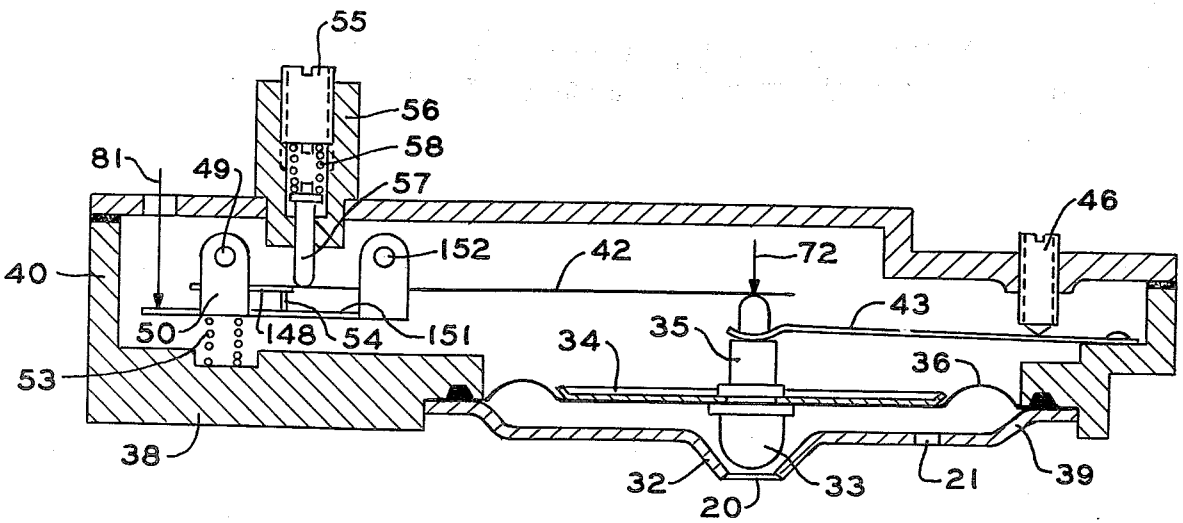
FIG. 3 shows a second embodiment of the pressure regulator with modified design of the part where the control value acts on the pressure regulator.

FIG. 3 shows an embodiment of the diaphragm pressure regulator in which the transmission lever 151 and the intermediate lever 148 have interchanged their relative position compared to the arrangement of FIG. 1. In this way, it is possible to still further move outward from the line of alignment of diaphragm 36 and closure member carrier 35 the point of engagement of the control value corresponding to pin 62 of the temperature controller (see arrow 81) as well as the adjustment screw 55 for adjusting spring 42. Transmission lever 151 is tiltable around stationary axis 152 and is tilted in counter-clockwise direction when the fore of the control value according to arrow 81 against the force of reset spring 53 increases. Tilting axis 49 for intermediate lever 148 is borne in two corner straps 50 of transmission lever 151. Its support point is located on the side of axis 152 of transmission lever 151 which is opposite to closure member carrier 35. The operation of the embodiment of FIG. 3 is the same as previously described with respect to FIG. 1. Abutment 54 again limits the tilting of intermediate lever 148 in clockwise direction.

I claim:

1. A diaphram operated pressure regulator, in particular for controlling the servo control pressure for a gas control apparatus, comprising a housing enclosing a valve, a diaphram carrying a closure member for the valve, a first adjusting spring biasing the closure member in the closing direction and determining the maximum outlet pressure of the regulator, a second adjusting spring biasing the closure member in the closing direction and determining the minimum outlet pressure of the regulator, a cover for said housing, a first adjusting screw carried by said cover for adjusting said second adjusting spring, means for adjusting the first adjusting spring including an externally exchangeable auxiliary spring guided in a threaded hole in said cover closed by a second adjusting screw, and a transmission lever by which the force of a thermo-mechanical transducer acts upon the first adjusting spring, the adjusting screws for the two adjusting springs as well as the transmission lever being located outside the line of alignment of the valve and closure member, the transmission lever borne tiltably with its one end around a stationary axis and carrying adjacent its free end a support for a tilting bearing, an intermediate lever being rotatably borne in said tilting bearing and carrying said first adjusting spring, the intermediate lever with its end facing the second adjusting screw for the first adjusting spring abutting against an abutment of the transmission lever, the transmission lever being biased by a spring which, with its one side, engages the housing and which operates opposite the force of a control value.

2. Pressure regulator according to claim 1, characterized in that the exchangeable auxiliary spring, biased by adjusting screw, engages the first adjusting spring between the abutment and the closure member.

3. Pressure regulator according to claim 1 or 2, characterized in that the end of transmission lever which carries the tilting bearing for the intermediate lever seen from its stationary support extends in the direction to the closure member and the force of the control valve engages the transmission lever between the two bearing points.

4. Pressure regulator according to claim 1, characterized in that the end of the transmission lever carrying the tilting bearing for the intermediate lever seen from its stationary support extends opposite to the closure member and the force of the control valve engages the transmission lever on that side of the transmission lever which is opposite the tilting bearing for the intermediate lever.

* * * * *